US009583863B1

(12) United States Patent
Rittinghaus

(10) Patent No.: US 9,583,863 B1
(45) Date of Patent: Feb. 28, 2017

(54) CHILD-SAFETY ELECTRICAL SOCKET

(71) Applicant: Schulte-Elektrotechnik GmbH & Co. KG, Luedenscheid (DE)

(72) Inventor: Hendrik Rittinghaus, Schalksmuehle (DE)

(73) Assignee: Schulte-Elektrotechnik GmbH & Co. KG, Luedenscheid (DE)

( * ) Notice: Subject to any disclaimer, the term of this patent is extended or adjusted under 35 U.S.C. 154(b) by 0 days.

(21) Appl. No.: 15/132,434

(22) Filed: Apr. 19, 2016

(30) Foreign Application Priority Data

Dec. 14, 2015 (DE) ..... 10 2015 121 684

(51) Int. Cl.
*H01R 13/44* (2006.01)
*H01R 13/453* (2006.01)

(52) U.S. Cl.
CPC ..... *H01R 13/4532* (2013.01)

(58) Field of Classification Search
USPC ..... 439/138
See application file for complete search history.

(56) References Cited

U.S. PATENT DOCUMENTS 3,980,372 A 9/1976 Ranzanigo
5,066,238 A * 11/1991 Shieh ..... H01R 13/4532 439/137
6,979,212 B1 * 12/2005 Gorman ..... H01R 13/4538 174/66
7,114,968 B2 * 10/2006 Healy ..... H01R 13/453 439/137
7,312,963 B1 * 12/2007 Radosavljevic ..... H01R 13/641 361/115
8,242,362 B2 8/2012 Castaldo et al.
8,974,239 B2 * 3/2015 Tomimbang ..... H01R 13/453 439/140
9,048,559 B2 * 6/2015 Huang ..... H01R 13/4534
9,059,530 B2 * 6/2015 Byrne ..... H01R 13/4534
9,450,325 B1 * 9/2016 Lai ..... H01R 13/4534
2002/0097546 A1 * 7/2002 Weinberger ..... H01R 13/713 361/103
2004/0203270 A1 * 10/2004 Wang ..... H01R 13/4534 439/136

* cited by examiner

*Primary Examiner* — Jean F Duverne
(74) *Attorney, Agent, or Firm* — Collard & Roe, P.C.

(57) ABSTRACT

A child-safety electrical socket includes a cover having at least two contact introduction apertures, which cover is disposed on a housing, and underneath which cover a slider is positioned, which stands under the influence of a spring, which supports itself on an intermediate bottom in the housing, wherein the intermediate bottom has at least two apertures and the slider has at least two apertures, which are provided with inclined surfaces, and the slider is disposed in the housing so as to rotate. The slider has a plate-like shape and stands in contact with guides on its circumference, which guides are provided on the cover, on the side facing toward the intermediate bottom.

5 Claims, 8 Drawing Sheets

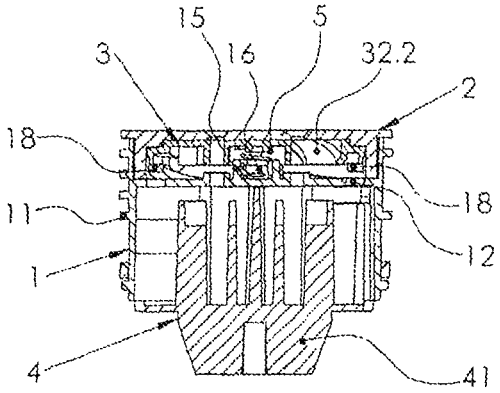
A-A Fig. 5
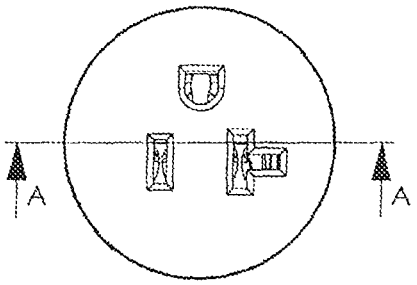

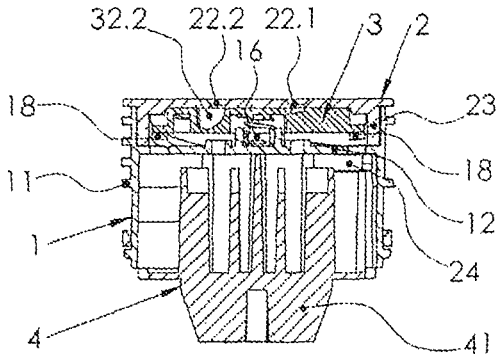
A-A Fig. 6
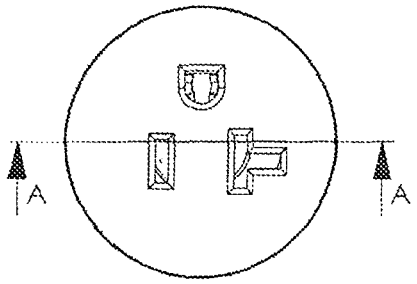

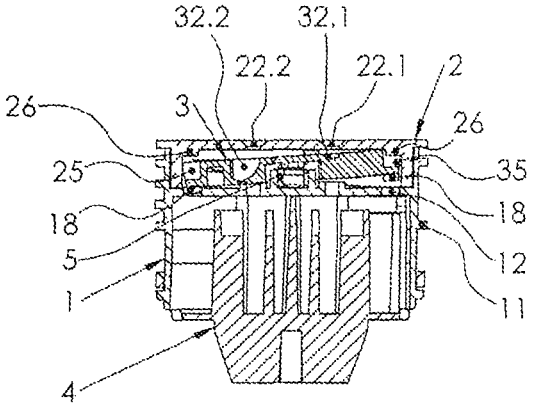
A-A Fig. 7
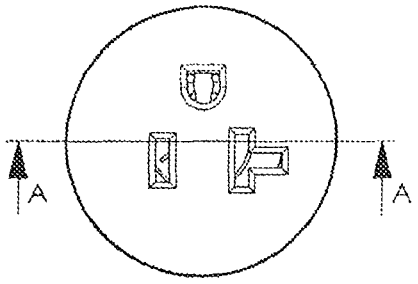

CHILD-SAFETY ELECTRICAL SOCKET

CROSS REFERENCE TO RELATED APPLICATIONS

Applicant claims priority under 35 U.S.C. §119 of German Application No. 10 2015 121 684.1 filed Dec. 14, 2015, the disclosure of which is incorporated by reference.

BACKGROUND OF THE INVENTION

1. Field of the Invention

The invention relates to a child-safety electrical socket comprising a cover having at least two contact introduction apertures. The cover is disposed on a housing, and underneath the cover a slider is positioned, which stands under the influence of a spring, which supports itself on an intermediate bottom in the housing. The intermediate bottom has at least two apertures and the slider has at least two apertures, which are provided with inclined surfaces.

2. Description of the Related Art

Electrical outlets usually consist of an insulation material socket, which can be mounted in a box inserted into or onto a wall, a cable duct or a piece or furniture. The socket has electrical contact elements for connecting the supply wires as well as accommodation contacts for the contact pins of a plug. A cover is set in front of the insulation material socket.

Child-safety electrical outlets have the task of preventing a child who is attempting to place a pointed metal object into an electrical outlet from coming into contact with voltage-carrying contacts and being injured by an electrical shock. For this purpose, a safety device is provided, which closes off the contact introduction apertures of the cover in the unused state of the electrical outlet. This device is configured so that the contact introduction apertures are released only when at least two plug contact pins are inserted at the same time; in contrast, if only one pointed object or only one plug contact pin is inserted, release is prevented.

From U.S. Pat. No. 8,242,362 B2, a child-safety electrical outlet is known, in which a slider is disposed underneath a cover, which slider is spring-loaded and has an aperture. The slider is provided with a rib that has an inclined surface that interacts with a cutout in the housing of the electrical outlet, which cutout also has an inclined surface. If no plug is inserted into the electrical outlet, the slider lies against the cover. If a plug is inserted into the contact introduction apertures in the cover, with both of its plug contact pins at the same time, the plug contact pins enter into contact with the slider. When the plug pins are inserted further, the slider slides along the inclined surface with its rib, counter to the force of the spring, downward into the cutout, and, at the same time, radially into the interior of the electrical outlet, until a stop has been reached. In this position, the slider releases the insertion slots for the plug contact pins, so that the plug can assume its functional position. If, in contrast, only one plug contact pin or a pointed object is inserted into a contact introduction aperture, the slider tilts and is held captured, so that the insertion slots remain covered.

An alternative embodiment is known from U.S. Pat. No. 3,980,372 A. It describes a child-safety electrical outlet, which has a housing having an upper part and a lower part, and comprises contact introduction apertures for plug pins. A protective crosspiece composed of two wings is rotatably mounted underneath the contact introduction apertures. The protective crosspiece stands under the influence of a spring, which turns the wings of the protective crosspiece under the contact introduction apertures. A centered axle journal is provided at the surfaces of the upper housing part and the lower housing part that face toward one another, about which journal the protective crosspiece can be rotated. For this purpose, the protective crosspiece has a central bearing bore. Furthermore, the protective crosspiece has a contour that comes to a point in the center, on its side facing the lower housing part. If a plug is inserted into the contact introduction apertures in the upper housing part with both of its plug contact pins at the same time, the plug contact pins enter into contact with the wings of the protective crosspiece. When the plug contact pins are inserted further, the pins slide along the inclined surfaces of the wings, thereby causing the protective crosspiece to perform a rotational movement counter to the force of the spring, until the wings make contact with the housing. In this position, the protective crosspiece releases the insertion slots for the plug contact pins, so that the plug can assume its functional position. If, in contrast, only one plug contact pin or a pointed object is inserted into a contact introduction aperture, the protective crosspiece tilts about the tip and is held captured. Rotation is thereby prevented, so that the insertion slots remain covered.

The known child-safety electrical outlets fundamentally meet the demands made on them. Nevertheless, because of the very slight construction size of the slider or of the protective crosspiece, which is brought about by the limited construction space present in the electrical outlet, functional problems can occur, particularly during proper use by means of insertion of a plug. As a result, the known child-safety electrical outlets are inconvenient to use. In addition, the embodiments having a rotating protective crosspiece are capable of functioning only when the mounting of the rotating crosspiece is mounted centered relative to the apertures of the voltage-conducting contacts.

SUMMARY OF THE INVENTION

Against this background, it is the task of the present invention to create a child-safety electrical outlet that makes available reliable protection against electrical shocks in the event of improper use of the electrical outlet, on the one hand, and on the other hand allows problem-free and therefore convenient use. According to the invention, this task is accomplished by means of a child-safety electrical outlet including a cover having at least two contact introduction apertures, which cover is disposed on a housing, and underneath which cover a slider is positioned, which stands under the influence of a spring, which supports itself on an intermediate bottom in the housing. The intermediate bottom has at least two apertures and the slider has at least two apertures, which are provided with inclined surfaces. The slider is disposed in the housing so as to rotate and has a plate-like shape and stands in contact with guides on its circumference, which guides are provided on the cover, on the side facing toward the intermediate bottom.

With the invention, a child-safety electrical outlet is created, which makes available reliable protection against electrical shocks in the event of improper use of the electrical outlet, on the one hand, and allows problem-free and therefore convenient use, on the other hand. The problem-free function is brought about in that the slider stands in contact with the guides provided on the cover because of its plate-like shape. As a result, the slider is prevented from leaving its predetermined position. Therefore problem-free functioning is permanently guaranteed.

It is advantageous if the slider is provided with two cams on its side facing the intermediate bottom, which cams are rounded off at their free ends and lie on an axis. The cams form a tilt axis that results in tilting of the slider if only one plug contact pin or a pointed object is inserted into a contact introduction aperture, so that release of the contacts is prevented.

In a further development of the invention, at least two tabs having an inherent bias are provided on the intermediate bottom. The tabs ensure that the slider is pressed against the cover in the rest position, in which no plug is inserted into the electrical outlet, and thereby the contact introduction apertures are reliably covered.

In a further embodiment, the apertures of the intermediate bottom are provided with frames. The frames additionally secure the apertures to the plug contacts of the electrical outlet, because in this way, introduction of a pointed object is prevented in the unlikely event of destruction of the slide by force.

Preferably, the guides are provided with hooks that have an engagement projection at their free end. The hooks serve for attaching the cover to the housing. In this regard, the engagement projections increase the clamping force of the hooks on the intermediate bottom of the housing.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

FIG. 5 is a longitudinal section through the electrical outlet shown in FIG. 1, in the deactivated state of the slider;

FIG. 6 is a longitudinal section through the electrical outlet shown in FIG. 1, in the activated state of the slider;

FIG. 7 is a longitudinal section through the electrical outlet shown in FIG. 1, in the unilaterally stressed state of the slider;

DETAILED DESCRIPTION OF THE EMBODIMENTS

Figure 1:
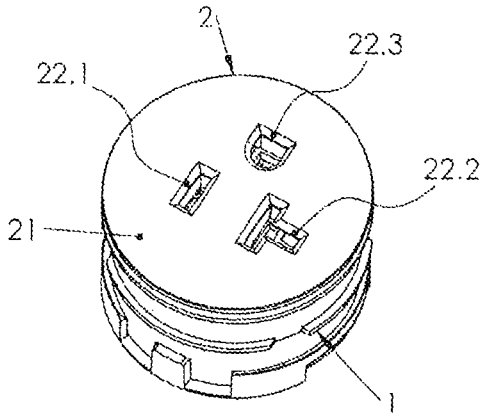
FIG. 1 is a three-dimensional representation of a child safety electrical outlet.
Figure 2:
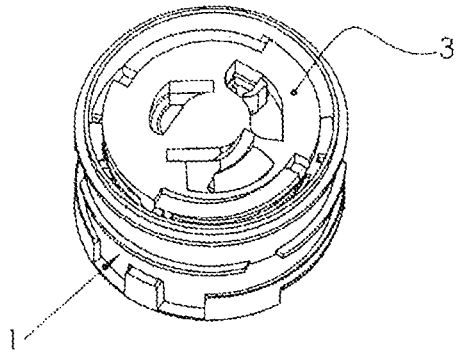
FIG. 2 is a three-dimensional representation of the electrical outlet shown in FIG. 1, without a cover, in the activated state of the slider.
Figure 3:
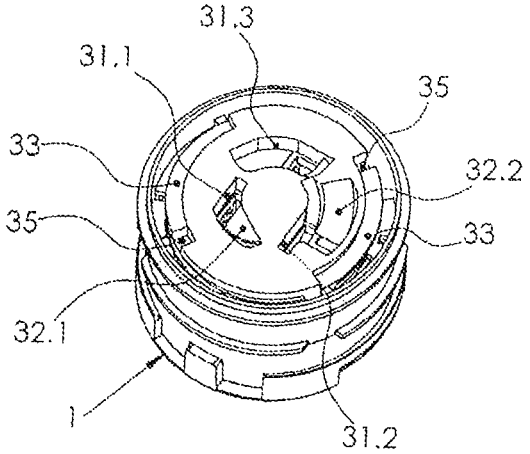
FIG. 3 is a three-dimensional representation of the electrical outlet shown in FIG. 1, without a cover, in the deactivated state of the slider.

The child-safety electrical outlet selected as an exemplary embodiment has a housing 1, on which a cover 2 is disposed. See FIG. 1. A slider 3 shown in FIG. 2 is positioned under the cover 2, which slider stands under the influence of a spring 5 shown in FIG. 5. On the side facing away from the cover 2, the housing 1 is closed off with a bottom 4. The housing 1 is suitable for accommodating plug contacts and contacts for a grounding pin—not shown.

Figure 4:
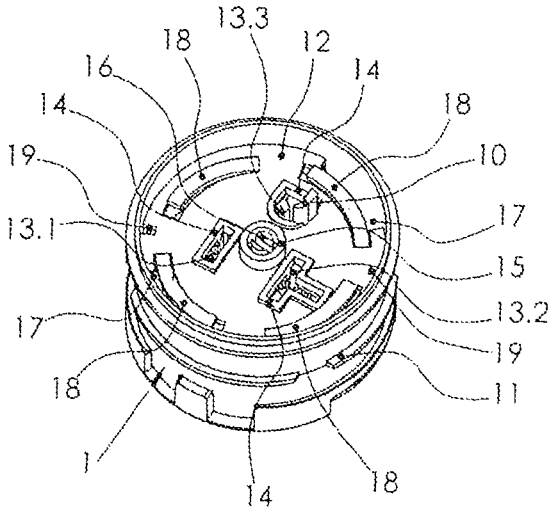
FIG. 4 is a three-dimensional representation of the electrical outlet shown in FIG. 1, without a cover and a slider.

The housing 1 is produced from an insulation material. It has a barrel-like configuration. On the outside, the housing 1 is provided with partial ring sections 11, shown in FIG. 4, which serve for attaching the electrical outlet into an installation apparatus inserted into a wall, a cable duct or a piece of furniture. On the inside, the housing 1 is provided with an intermediate bottom 12. The intermediate bottom 12 has apertures that serve for the plug contact pins (apertures 13.1 and 13.2) or a grounding pin (aperture 13.3) of the plug to be inserted to pass through. The apertures 13.1, 13.2., 13.3 are provided with frames 14. The aperture 13.3 is furthermore provided with a stop 10 that extends vertically in the direction of the cover 2—upward.

In its center, the intermediate bottom 12 has a ring 15 in which an accommodation 16 for attaching the spring 5 is disposed. On its circumference, the intermediate bottom 12 has two recesses 17, which are disposed to lie opposite one another. Furthermore, in the exemplary embodiment, the intermediate bottom 12 has four tabs 18, which are configured in the manner of leg springs, and consequently have an inherent bias. The tabs 18 project upward beyond the intermediate bottom 12 in the unstressed state (see FIG. 4). Offset relative to the recesses 17, the intermediate bottom 12 is provided with two apertures 19 that have an essentially square cross-section and are disposed to lie opposite one another on a center line of the intermediate bottom 12, which is configured to be circular.

Figure 8:
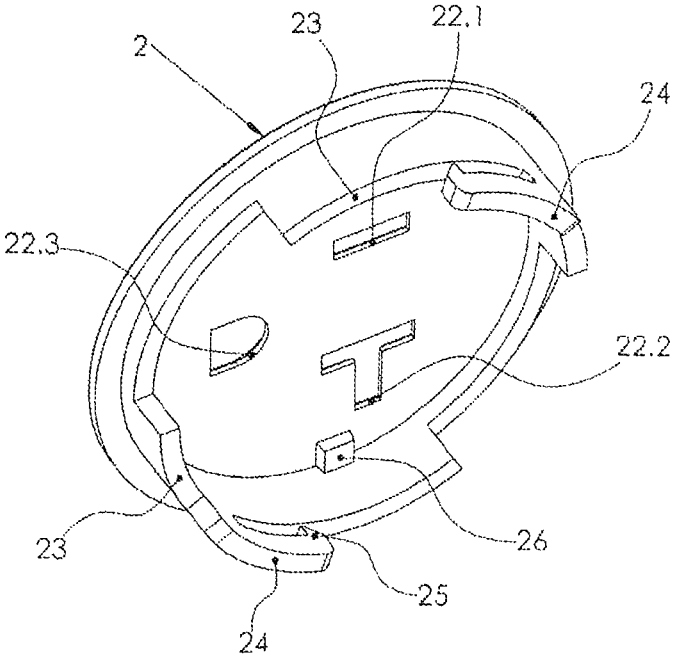
FIG. 8 is a perspective view of a cover from below.

The cover 2 has a circular configuration. It consists of a plate 21, which has three contact introduction apertures 22.1, 22.2, 22.3 in the exemplary embodiment. The plate 21 is provided with guides 23 shown in FIG. 6 on its side facing toward the intermediate bottom 12—referred to as "underside" hereinafter—which guides extend on a circular track, section by section. They are consequently configured in the shape of partial rings. The guides 23 are provided with hooks 24 that have engagement projections 25 at their free ends. See FIG. 8. The hooks 24 have dimensions, in the horizontal direction, in each instance, that essentially correspond to the recesses 17 in the intermediate bottom 12. Consequently, the hooks 24 are able to enter into the recesses 17. In the region of the guides 23, two steps 26 configured essentially in block shape are disposed to lie diametrically opposite one another; they project away from the underside of the plate 21.

Figure 9:
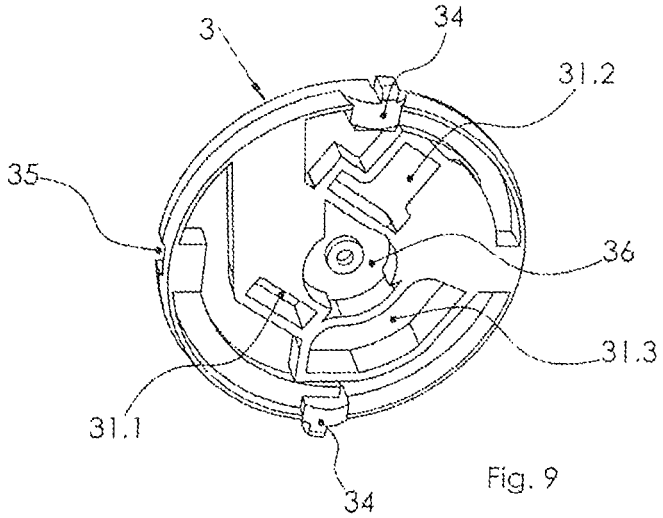
FIG. 9 is a perspective view of a slider from below.
Figure 10:
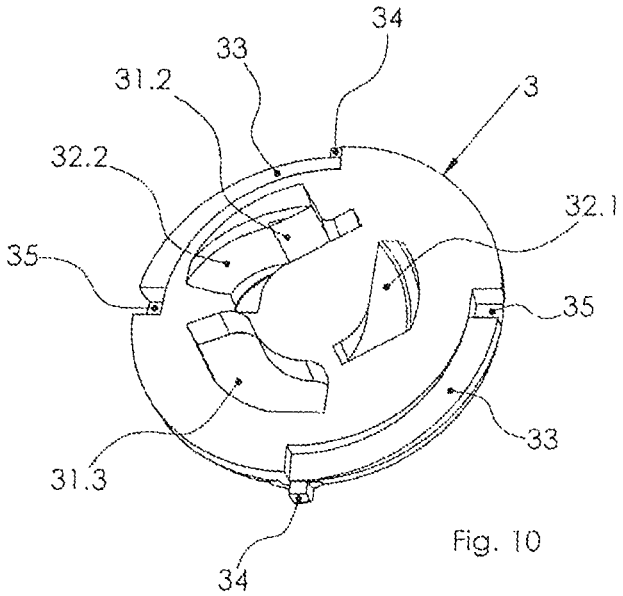
FIG. 10 is a perspective view of a slider from above.

The slider 3 has a plate-like shape. It has a circular form. In the exemplary embodiment, the slider 3 has three apertures, of which the apertures 31.1 and 31.2 are provided for the plug contact pins to pass through, and the aperture 31.3 is provided for the grounding pin to pass through. On its side facing toward the cover 2—referred to as the "top" hereinafter—the apertures 31.1 and 31.2 are provided with inclined surfaces 32.1 and 32.2. On the outside, the slider 3 has slide surfaces 33 on its top, which surfaces run in arc shape. The slide surfaces 33 lie opposite one another. At the lowest point of the slide surfaces, there are cams 34, in each instance, which project radially beyond the circumference of the slider 3. See FIGS. 9 and 10. At the same time, the cams 34 project beyond the (under)side of the slider 3 that faces toward the intermediate bottom 12. The cams 34 are structured to be rounded off on their side that faces toward the intermediate bottom 12. Furthermore, the slider 3 is provided with two pockets 35 on its top, which are disposed to lie diametrically opposite one another at the edge of the slider.

On its underside, the slider 3 has a depression 36 in its center. A spring 5 is captively attached in the depression 36. The spring 5 corresponds, in the installed state, with the accommodation 16 provided in the ring 15, in the center of the intermediate bottom 12, for this purpose, on which accommodation the spring 5 supports itself in the installed state. See FIG. 5.

The bottom 4 is configured in known manner. It has a socket 41, which is provided to accommodate plug pin contacts and grounding contacts—not shown. Furthermore, the socket 41 is provided with passage apertures for electrical lines, to be connected with the plug pin contacts. The bottom 4 is also produced from insulation material.

In the unused state of the electrical outlet, the apertures 13.1 and 13.2 in the intermediate bottom 12 are covered by the slider 3, as can be seen in FIG. 2. Only the aperture 13.3, which serves to accommodate the grounding pin, is not covered. Such a cover is not required, because no risk of electrical shock proceeds from the contact for the grounding pin in the electrical outlet. If a plug is introduced into the contact introduction apertures 22.1, 22.2, 22.3 of the cover 2 with its plug contact pins, the plug contact pins come into contact with the slider 3. As they do so, they impact the inclined surfaces 32.1, 32.2. When the plug contact pins are inserted further, the pins slide along the inclined surfaces 32.1, 32.2 of the slider 3. As a result, the slider 3 is rotated counter to the force of the spring 5, so that the apertures 13.1 and 13.2 are released.

During the insertion process, first the slider 3 is moved vertically in the direction of the intermediate bottom 12, until the steps 26 are released by the pockets 35. Then, the slider 3 performs a rotational movement, during which the cams 34 run along the tabs 18 and the steps 26 run along the slide surfaces 33, thereby causing the slider 3 to perform a vertical movement back in the direction of the cover 2. The rotational movement of the slider 3 is limited by the stop 10 on the intermediate bottom 12. In this position of the slider 3, the plug contacts are released and the plug contact pins, just like a grounding pin that might be present, can be introduced into the respective apertures 13 in the intermediate bottom 12. Because the slider 3 lies against the back side of the cover 2 in this position, the tabs 18 are also back in the unstressed state.

When the plug is pulled out of the electrical outlet, the slider 3 is rotated back into its initial position by the force of the spring 5. Specifically, the slider 3 is first moved vertically in the direction of the intermediate bottom 12; this movement is brought about by the steps 26 sliding along the slide surfaces 33. After the plug has been pulled completely out of the electrical outlet, and after the end of the slide surfaces 33 has been reached, the slider 3 springs back into its initial position under the influence of the spring force of the tabs 18, in which position the steps 26 lie in the pockets 35. The slider 3 then lies, with its top, against the side of the plate 21 of the cover 2 that faces toward it, once again.

If improper use of the electrical outlet occurs, for example by insertion of only one plug contact pin or of some other pointed object, rotational movement of the slider 3, to release the plug contacts, is hindered. This hindrance is brought about in that a unilateral stress on one of the inclined surfaces 32.1 or 32.2 leads to a tilting movement of the slider 3 (see FIG. 7). This tilting movement is brought about by the cams 34 with their rounded-off shape, because the cams lie diametrically opposite one another and thereby form a tilt axis. When stress is placed on one of the inclined surfaces 32.1 or 32.2, which lie outside of the tilt axis between the cams 34, the slider 3 tilts toward one of the two sides, wherein one of the steps 26 remains in the pocket 35 of the slider 3 assigned to it, whereas the other step 26 tilts downward in the direction of the intermediate bottom 12, counter to the force of the tab 18 disposed underneath it. The slider 3 therefore continues to be captured in the pocket 35 on the non-tilted side, by means of the step 26, and is thereby locked in place.

The child-safety electrical outlet according to the invention offers reliable securing to prevent improper use of the electrical outlet. Problem-free operation is possible by means of the configuration according to the invention. This result is brought about, on the one hand, in that the slider 3 is reliably guided on the guides 23 of the cover 2 during a rotational movement. At the same time, this result is brought about by means of guiding the slider 3 along the steps 26 of the cover 2, using the slide surfaces 33. By means of these measures, the slider 3 is reliably prevented from leaving its functionally correct position, both in the locked and the non-locked state. At the same time, it is guaranteed, by means of the tabs 18 configured in the manner of leg springs, that the slider 3 lies against the side of the plate 21 of the cover 2 that faces toward it, in the non-used state of the plug. By means of the design configuration of the slider 3, improper use of the electrical outlet is prevented, namely insertion of a pointed metal object. Thereby the risk of an electrical shock is reduced. The risk of actually coming into contact with a plug contact is furthermore reduced by means of the frames 14 that surround the apertures 13.1, 13.2, 13.3.

Although at least one embodiment of the present invention has been shown and described, it is to be understood that many changes and modifications may be made thereunto without departing from the spirit and scope of the invention.

What is claimed is:

1. A child-safety electrical outlet comprising:

(a) a housing comprising an intermediate bottom having at least first and second intermediate bottom apertures;

(b) a cover disposed in the housing and having guides on a cover side facing toward the intermediate bottom and at least first and second contact introduction apertures;

(c) a slider rotatably disposed in the housing and positioned underneath the cover, the slider being self-supported on the intermediate bottom and having at least first and second slider apertures provided with inclined surface; and (d) a spring biasing the slider;

wherein the slider is plate shaped and has a circumference, the slider standing in contact with the guides on the circumference of the slider.

2. The electrical outlet according to claim 1, wherein the slider is provided with first and second cams on a slider side facing toward the intermediate bottom, wherein the first and second cams have rounded off free ends and lie on an axis.

3. The electrical outlet according to claim 1, further comprising at least first and second tabs provided on the intermediate bottom, wherein the first and second tabs have an inherent bias.

4. The electrical outlet according to claim 1, wherein the immediate bottom apertures are provided with frames.

5. The electrical outlet according to claim 1, wherein the guides are provided with hooks, each hook having an engagement projection at a free end of the hook.

* * * * *